US005423095A

United States Patent [19]

Bearer

[11] Patent Number: 5,423,095

[45] Date of Patent: Jun. 13, 1995

[54] BATHTUB PARTITION

[76] Inventor: Gene M. Bearer, 5713 Kentucky Ave., Altoona, Pa. 16602

[21] Appl. No.: 61,562

[22] Filed: May 17, 1993

[51] Int. Cl.[6] ..... E03C 1/186

[52] U.S. Cl. ..... 4/514

[58] Field of Search ..... 4/514; 248/205.5, 205.6, 248/206.3, 206.2

[56] References Cited

U.S. PATENT DOCUMENTS

| | | | |
|---|---|---|---|
| 668,322 | 2/1901 | Stephen | 4/514 |
| 1,817,330 | 8/1931 | Wilson | 4/514 |
| 2,109,089 | 2/1938 | Moyes | 4/514 |
| 2,203,052 | 6/1940 | Hanson | 4/514 |
| 2,557,434 | 6/1951 | Hoverder | 248/205.6 X |
| 4,333,188 | 6/1982 | Jensen | 4/514 |

FOREIGN PATENT DOCUMENTS

| | | | |
|---|---|---|---|
| 1457645 | 9/1966 | France | 4/638 |

*Primary Examiner*—Charles E. Phillips

[57] ABSTRACT

A partition structure arranged to transversely divide a bathtub to minimize water usage to accommodate an infant or small child therewithin is provided to include a continuous U-shaped resilient support member arranged to sealingly engage the side walls and floor of the bathtub, wherein a rigid web received within and coextensive relative to the support member effects division of the bathtub in use.

1 Claim, 6 Drawing Sheets

FIG 3
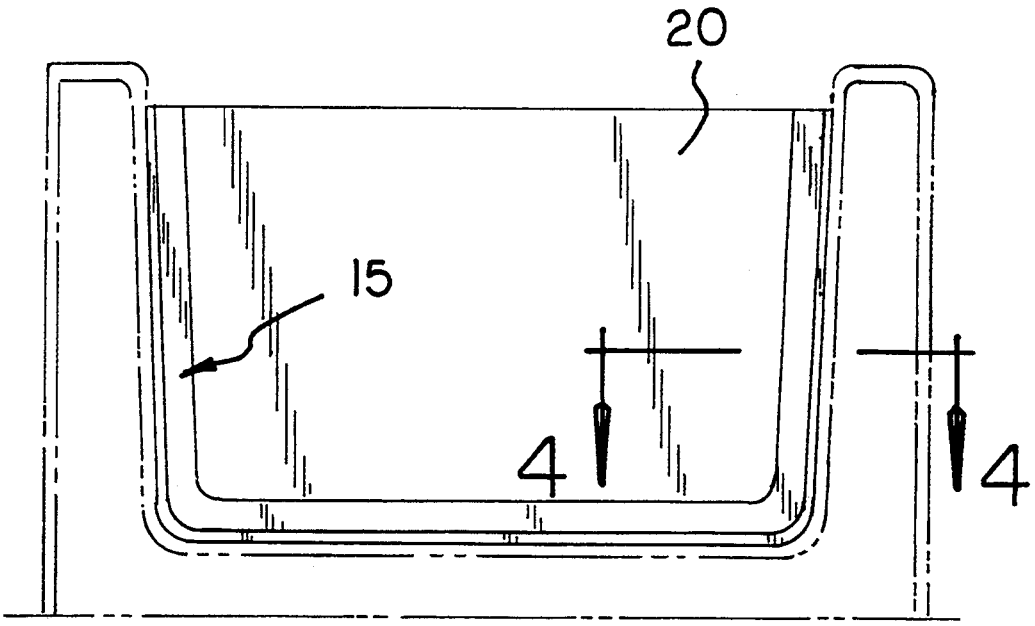
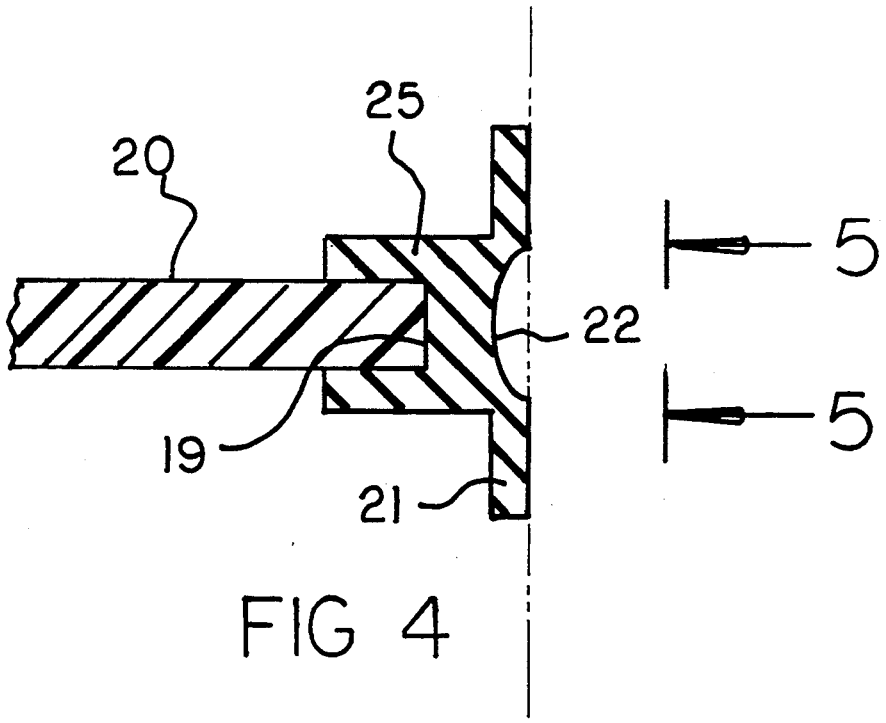
FIG 4

FIG 7
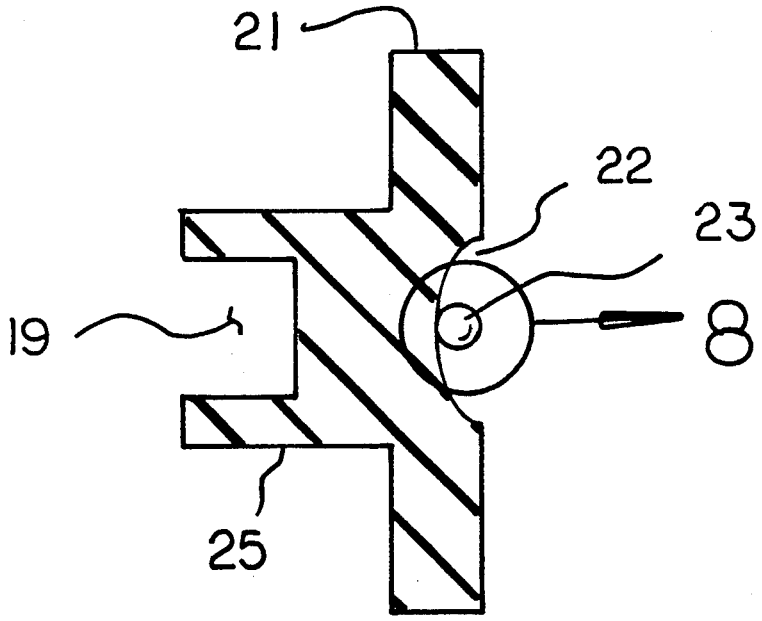
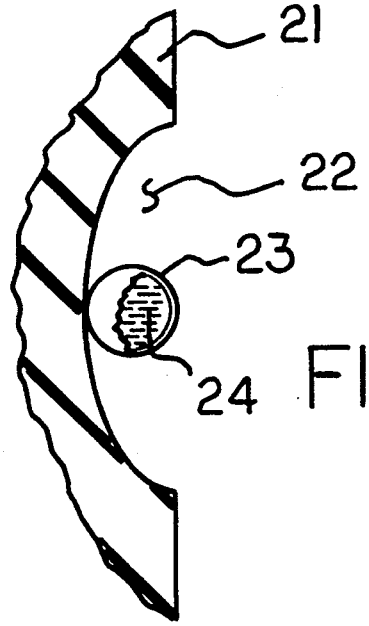
FIG 8

BATHTUB PARTITION

BACKGROUND OF THE INVENTION

1. Field of the Invention

The field of invention relates to bathtub structure, and more particularly pertains to a new and improved bathtub partition permitting transverse partitioning of a bathtub to minimize water usage relative to the bathing of an infant and the like.

2. Description of the Prior Art

A bath tub partition device has been addressed in the prior art and set forth in U.S. Pat. No. 3,713,179 to Dubiel wherein a structure is arranged to provide division of but not sealing division of the bathtub to minimize risk to an infant slipping within the water during a bathing procedure.

The instant invention attempts to overcome deficiencies of the prior art by providing for such bathtub partition structure to effect sealing division of the bathtub in a manner to Limit water usage between a water outlet of the bathtub and the partition structure and in this respect, the present invention substantially fulfills this need.

SUMMARY OF THE INVENTION

In view of the foregoing disadvantages inherent in the known types of bathtub apparatus now present in the prior art, the present invention provides a bathtub partition wherein the same is addressed to the fluid-tight division of a bathtub cavity. As such, the general purpose of the present invention, which will be described subsequently in greater detail, is to provide a new and improved bathtub partition which has all the advantages of the prior art bathtub apparatus and none of the disadvantages.

To attain this, the present invention provides a partition structure arranged to transversely divide a bathtub to minimize water usage to accommodate an infant or small child therewithin, to include a continuous U-shaped resilient support member arranged to sealingly engage the side walls and floor of the bathtub, wherein a rigid web received within and coextensive relative to the support member effects division of the bathtub use .

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bathtub partition which has all the advantages of the prior art bathtub apparatus and none of the disadvantages.

It is another object of the present invention to provide a new and improved bathtub partition which may be easily and efficiently manufactured and marketed.

It is a further object of the present invention to provide a new and improved bathtub partition which is of a durable and reliable construction.

An even further object of the present invention is to provide a new and improved bathtub partition which is susceptible of a low cost of manufacture with regard to both materials and labor, and which accordingly is then susceptible of low prices of sale to the consuming public, thereby making such bathtub partitions economically available to the buying public.

Still yet another object of the present invention is to provide a new and improved bathtub partition which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view of the invention.

FIG. 4 is an orthographic view, taken along the lines 4—4 of FIG. 3 in the direction indicated by the arrows.

FIG. 7 is an orthographic view, taken along the lines 7—7 of FIG. 6 in the direction indicated by the arrows.

FIG. 8 is an enlarged orthographic view of section 8 as set forth in FIG. 7.

DESCRIPTION OF THE PREFERRED EMBODIMENT

Figure 1:
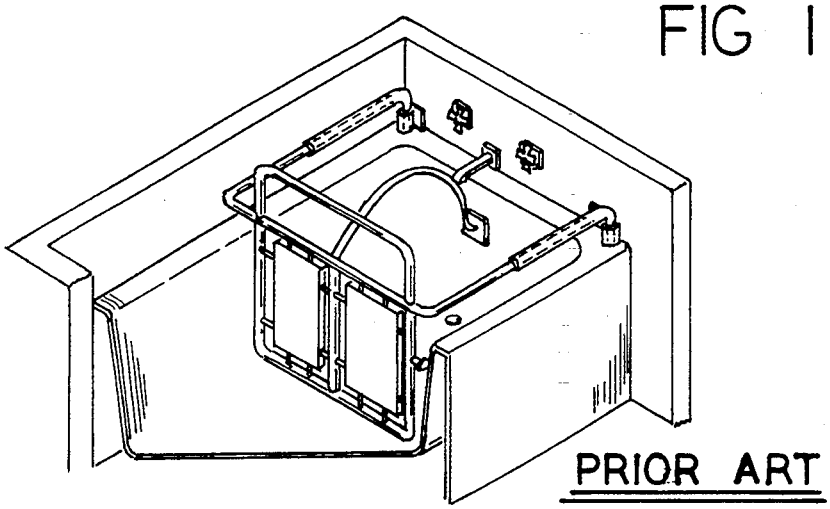
FIG. 1 is an isometric illustration of a prior art bathtub partition structure as set forth in U.S. Pat. No. 3,713,179.

With reference now to the drawings, and in particular to FIGS. 1 to 12 thereof, a new and improved bathtub partition embodying the principles and concepts of the present invention and generally designated by the reference numeral 10 will be described.

Figure 2:
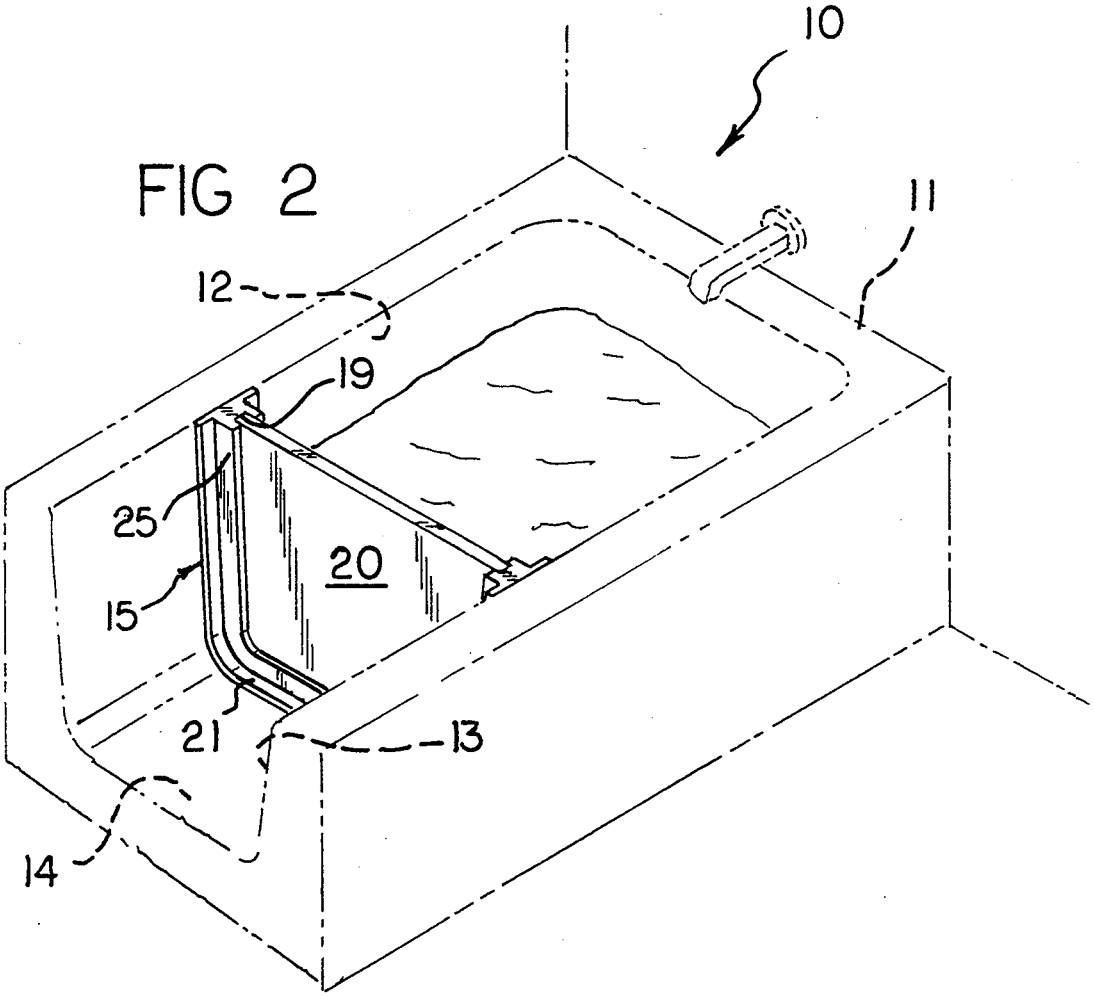
PRIOR ART FIG 2
FIG. 2 is an isometric illustration of the invention.
Figure 5:
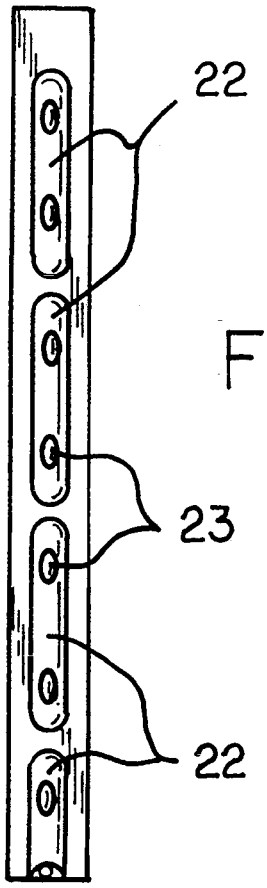
FIG. 5 is an orthographic view, taken along the lines 5—5 of FIG. 4 in the direction indicated by the arrows.
Figure 6:
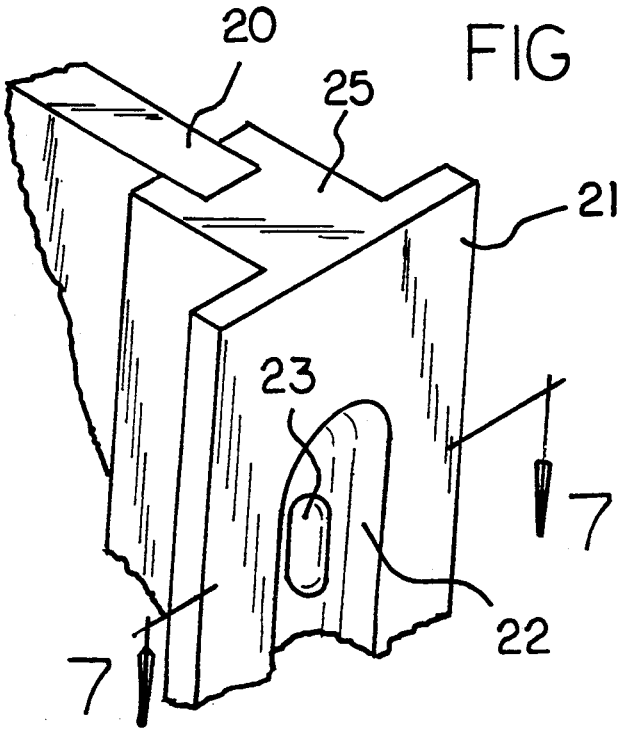
FIG. 6 is an isometric illustration of the invention employing frangible capsule members within the channel structure of the invention.

More specifically, the bathtub partition 10 of the instant invention essentially comprises the mounting within a bathtub 11, as the bathtub 11 has a first side wall 12 spaced from a second side wall 13 and a bathtub floor 14 extending between the first and second side walls 12 and 13 respectively. A U-shaped resilient support member 15 is provided, having a continuous U-shaped channel 19 mounted within a U-shaped mounting head 25. The U-shaped mounting head 25 is orthogonally and integrally attached to a support flange 21. Within the U-shaped channel 19 accordingly a rigid web 20 is received coextensively therewith as the rigid web 20 in association with the fluid impermeable sealing of the support flange 21 within the bathtub 10 confines water directed into the bathtub between the associated faucet and the rigid web 20, in a manner as indicated in FIG. 2. As illustrated in the FIGS. 4–7, the support flange 21 includes a plurality of support flange suction cup cavities 22 directed into the support flange 21 to enhance securement to the first and second side walls 12 and 13, as well as the floor 14 of the bathtub 11.

To enhance such securement, a plurality of frangible capsules 23 having a fluid lotion such as baby oil and the like 24 contained therewithin (see FIG. 8) are adhered within each of the suction cup cavities 22 to enhance securement to the bathtub walls and floor portion. The capsules may be replaced prior to mounting of the U-shaped support within the bathtub structure. The fluid within the cavities 22 provides for a continuous fluid film to enhance the attaching of the web 21 of the U-shaped support 15 to interior surfaces of a bathtub, as illustrated in a transverse relationship relative to the side walls, as indicated. In this manner, an infant and the like positioned within the bathtub is bathed using a minimum quantity of water, as well as permitting the confining of the infant limiting the infant's ability to slip beneath the water during such bathing procedures.

Figure 9:
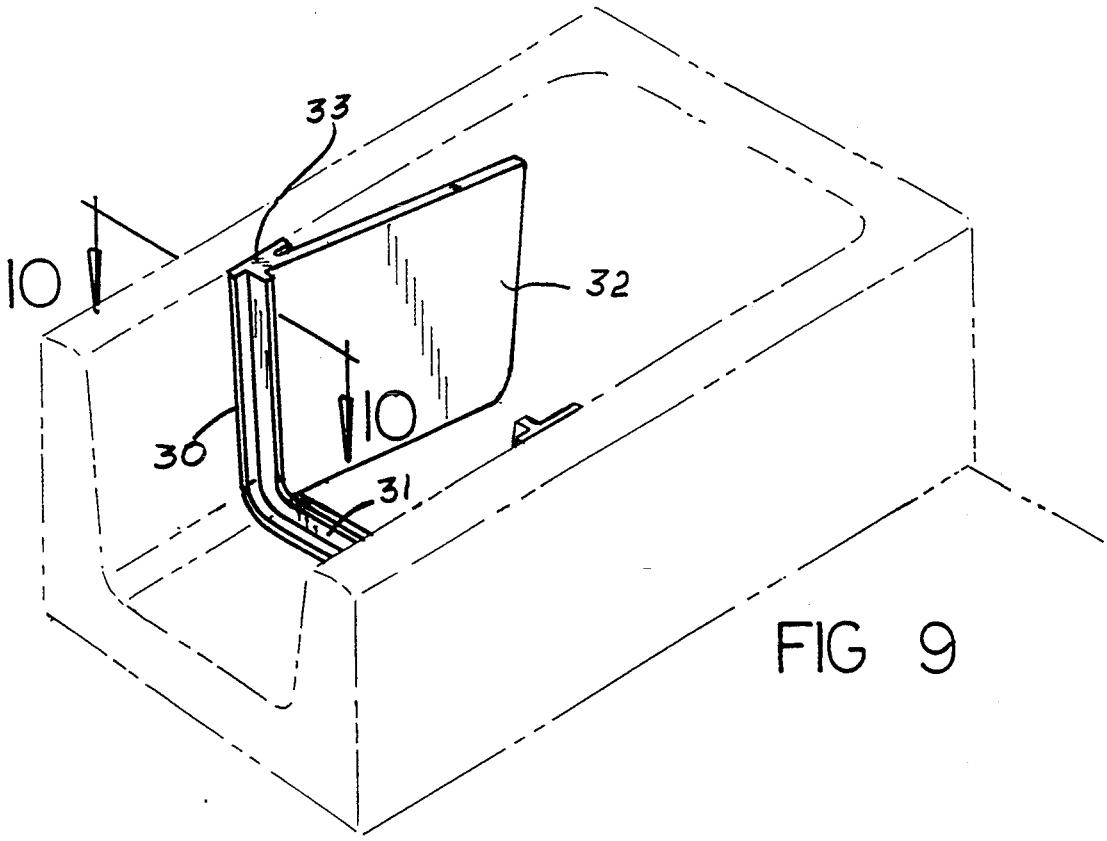
FIG. 9 is an isometric illustration of a further aspect of the invention.
Figure 10:
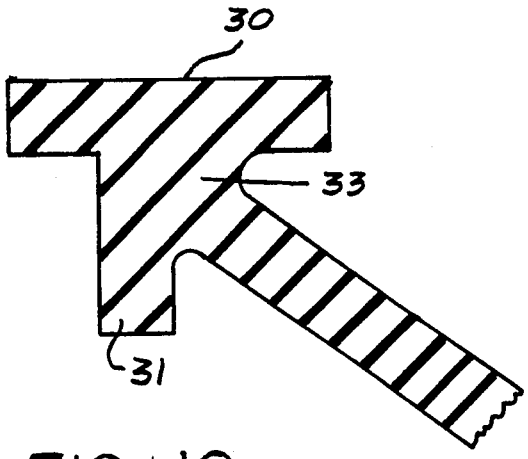
FIG. 10 is an orthographic view, taken along the lines 10—10 of FIG. 9 in the direction indicated by the arrows.

FIG. 9 is an isometric illustration of a further modified aspect of the invention wherein a U-shaped flange 30 mounted within a bathtub includes a U-shaped rib 31 orthogonally and coextensive with the flange 30. A door plate 32 includes a door plate hinge 33 mounted to the door plate 32 to a single leg of the U-shaped flange 30 at its intersection with the rib 31 such that the door plate hinge 33 biases the door plate 32 in contiguous communication with the flange 30 and the rib 31 to partition the bathtub structure.

Figure 11:
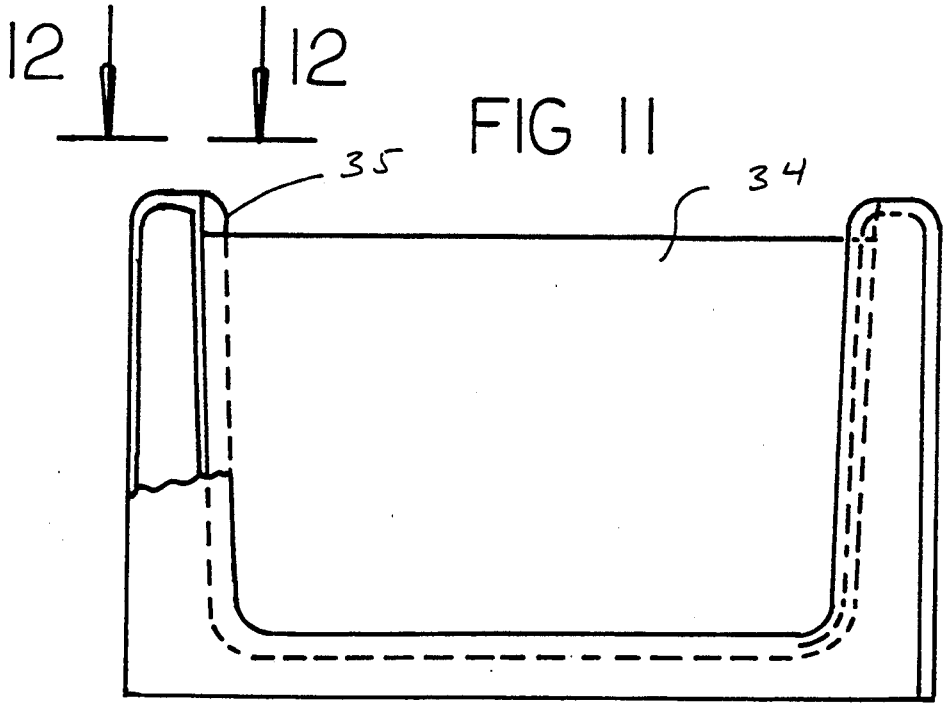
FIG. 11 is an orthographic view of a further modified aspect of a bathtub partition mounted to the associated bathtub.
Figure 12:
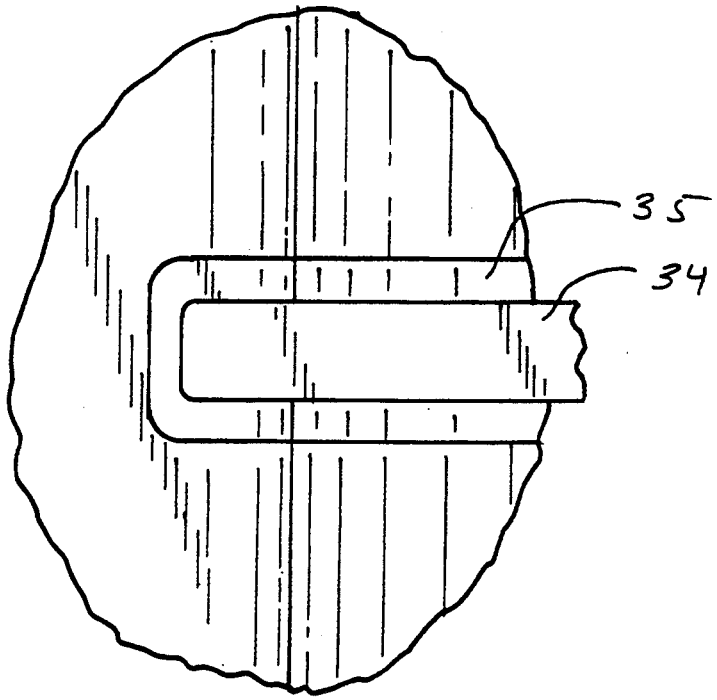
FIG. 12 is an orthographic view, taken along the lines 12—12 of FIG. 11 in the direction indicated by the arrows.

The FIG. 11 indicates a yet further modified aspect of the invention, wherein a generally U-shaped channel 35 includes a continuous slot coextensive with the channel 35 to receive a rigid channel door 34 slidably therewithin to provide for a further means of partitioning the associated bathtub structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bathtub partition arranged for positioning within a bathtub, wherein the bathtub partition comprises, a U-shaped resilient support member, including a continuous U-shaped channel, and a rigid web received coextensively within the U-shaped channel, wherein the rigid web is of a unitary construction, and the U-shaped support members includes a support flange and a mounting head, with the mounting head mounted orthogonally relative to the support flange, and the mounting head having the U-shaped channel therewithin, and the support flange includes a plurality of spaced suction cup cavities extending coextensively about the support flange in a facing relationship relative to the bathtub for securement to the bathtub, and each of the suction cup cavities includes at least one frangible capsule, the frangible capsule including a fluid lotion therewithin permitting the frangible capsule to rupture and direct the fluid lotion throughout each suction cup cavity for enhanced adherence within the bathtub, and the U-shaped resilient support member is of a T-shaped cross sectional configuration.

* * * * *